United States Patent [19]

Muranaka et al.

[11] Patent Number: 4,726,341

[45] Date of Patent: Feb. 23, 1988

[54] INDUCTION ARRANGEMENT FOR INTERNAL COMBUSTION ENGINE HAVING MULTIPLE INLET VALVES PER CYLINDER

[75] Inventors: Shigeo Muranaka, Yokosuka; Shigeru Kamegaya, Tokyo, both of Japan

[73] Assignee: Nissan Motor Co., Ltd., Yokohama, Japan

[21] Appl. No.: 917,588

[22] Filed: Oct. 10, 1986

[30] Foreign Application Priority Data

Oct. 14, 1985 [JP] Japan ..... 60-155668[U]

[51] Int. Cl.[4] ..... F02B 15/00

[52] U.S. Cl. ..... 123/432; 123/339; 123/442

[58] Field of Search ..... 123/432, 442, 308, 339, 123/585

[56] References Cited

U.S. PATENT DOCUMENTS 4,354,463 10/1982 Otani et al. ....., 123/188 M
4,378,000 3/1983 Moriya et al. ..... 123/442
4,576,131 3/1986 Sugiyama ..... 123/442
4,625,687 12/1986 Hatamura et al. ..... 123/432

FOREIGN PATENT DOCUMENTS 58-48712 3/1983 Japan .

*Primary Examiner*—E. Rollins Cross
*Attorney, Agent, or Firm*—Pennie & Edmonds

[57] ABSTRACT

Each cylinder of a multi-valve engine is provided with a bifurcate induction port which has a partition wall; a fuel injector which injects fuel toward the partition wall so that fuel is distributed into the two branches which lead to the inlet valves; and a flow control valve is disposed upstream of the partition wall and formed with one or more apertures which when the valve is closed, direct a flow or flows of air which pass close to the partition wall, entrain the injected fuel and induce a turbulent mixing action which forms an ignitable cloud of air-fuel mixture in close proximity to the spark plug.

8 Claims, 9 Drawing Figures

INDUCTION ARRANGEMENT FOR INTERNAL COMBUSTION ENGINE HAVING MULTIPLE INLET VALVES PER CYLINDER

BACKGROUND OF THE INVENTION

1. Field of the Invention

The present invention relates generally to an induction system for an internal combustion engine wherein each combustion chamber has a plurality of inlet valves and more specifically to an arrangement wherein a flow control valve is located upstream of the inlet valves.

2. Description of the Prior Art

FIGS. 1 and 2 show an induction arrangement disclosed in Japanese Patent Application First Provisional Publication No. 58-48712(1983) published on Mar. 22, 1983. As shown, this arrangement is applied to an internal combustion engine wherein each cylinder has two inlet valves 1, 2 and wherein the induction ports 4, 6 which cooperate with the valves, are formed in a manner to be fluidly discrete from one and other. An induction manifold 8 is formed with essentially separate induction passages 10, 11 and includes a flow control valve 12 which is located near the downstream end thereof.

In order to promote a strong swirl during a low speed/low load operation the flow control valve 12 is mounted on a shaft 14 which is arranged essentially parallel with respect to the axis of the cylinder and formed with a cut-out 16. The flow control valve 12 is closed during low load/low speed engine operation, whereby the cut out 16 functions to guide the flow of incoming air in a manner such as shown in FIG. 1 into the combustion chamber via inlet valve 2 in a manner which produces a strong swirling flow pattern therein.

A fuel injector 18 is arranged to inject fuel into the intake port 6 in a manner to be entrained in the relatively high speed flow of air produced when the flow control valve 12 is closed.

When the engine enters high load operation the flow control valve 12 is fully opened and assumes the position shown in broken line thus permitting the maximum charging efficiency of the arrangement to be realized. Under these conditions the window or aperture 20 formed in the wall which separates the induction passages formed in the induction manifold is closed and the flow of air which passes from passage 10 to passage 11 during low load operation is terminated.

However, this arrangement, when applied to engines wherein multiple inlet and exhaust valves are use per cylinder and it is necessary to locate the spark plug in or near the center of the combustion chamber, encounters the drawback that despite the formation of a strong swirl the plug electrodes are not located in a good position to initiate flame propagation with a consequent reduction in the reliability with which a lean air-fuel mixture can be ignited.

Further, when the engine is operated under high load and the flow control valve 12 is moved to its full open position, as the fuel is injected exclusively into intake port 6, distribution thereof within the combustion chamber tends to be insufficient leading to a corresponding loss of combustion efficiency and anti-knock properties.

SUMMARY OF THE INVENTION

It is an object of the present invention to provide an induction system which enables reliable ignition of lean air-fuel mixtures under low load/low speed engine operation and which further promotes good carburetion under high load modes thus increasing combustion efficiency and knock resistance.

In brief, the above object is achieved by an arrangement wherein each cylinder of a multi-valve engine is provided with a bifurcate induction port which has a partition wall; a fuel injector which injects fuel toward the partition wall so that fuel is distributed into the two branches which lead to the inlet valves; and a flow control valve which is disposed upstream of the partition wall. The flow control valve is formed with one or more apertures which, when the valve is closed, direct a flow of flows of air which pass close to the partition wall, entrain the injected fuel and induce a turbulent mixing action which forms an ignitable cloud of air-fuel mixture in close proximity to the spark plug.

More specifically, the present invention takes the form of an internal combustion engine which comprises: a combustion chamber; and induction manifold; means defining a bifurcate intake port having a main section in communication with said induction manifold and first and second branch sections being separated by a partition wall; first and second inlet valves which control the fluid communication between said combustion chamber and said first and second branch sections respectively; a fuel injector which injects fuel into the main section of said bifurcate intake port in a manner that fuel flows towards and enters both said first and second branch sections; and a flow control valve disposed upstream of said first and second branch sections both constructed and arranged that when the flow control valve assumes a closed position the air which is inducted into the combustion chamber via the induction manifold, follows a path which is close to the said partition wall, entrains the injected fuel and enters the combustion chamber in manner which mixes the air and fuel.

DETAILED DESCRIPTION OF THE PREFERRED EMBODIMENTS

Figure 3:
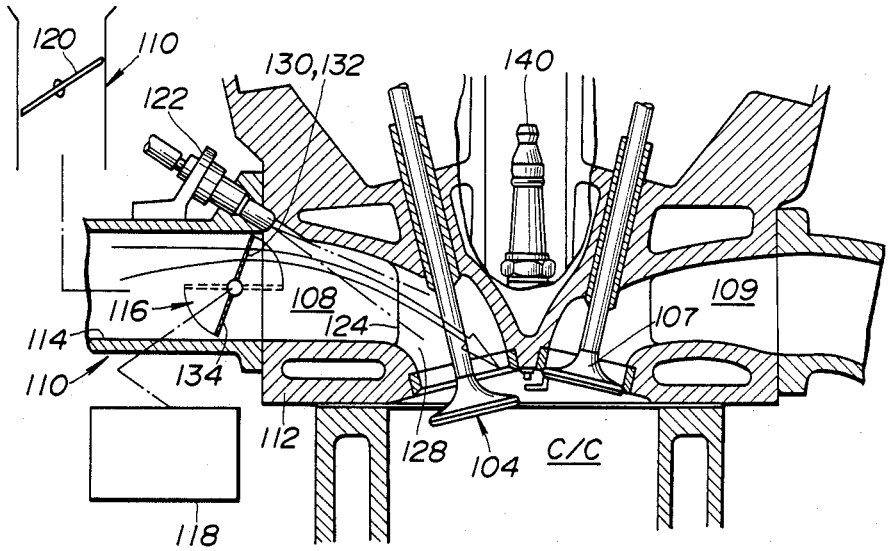
FIGS. 3 and 4 are sectional elevation and plan views, respectively, showing a first embodiment of the present invention.
Figure 4:
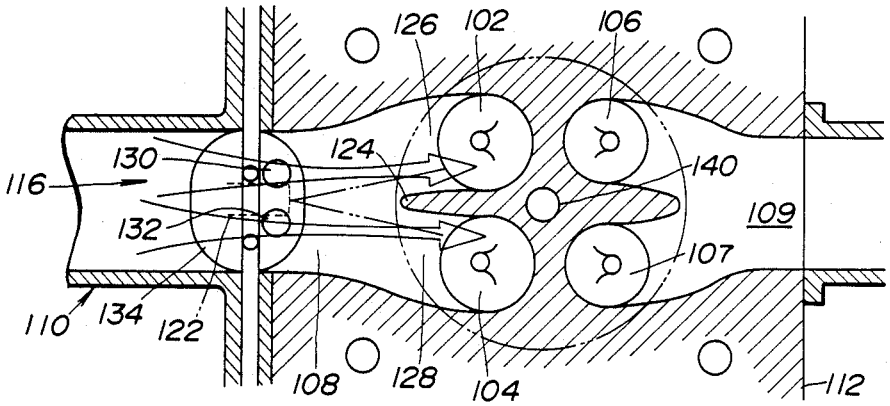

FIGS. 3 and 4 show a first embodiment of the present invention. In this arrangement each cylinder of the engine is equipped with two inlet valves 102, 104 and two exhaust valves 106, 107. The inlet valves 102, 104 cooperate with a bifurcate intake port arrangement 108. The exhaust valves 106, 107 cooperate with a similarly configured exhaust port 109. However, it should be noted that the configuration of the exhaust port 109 can be varied without effecting the basic concept of the present invention.

An induction manifold 110 is detachably connected to the cylinder head of the engine. In this embodiment the branch runners 114 of the manifold are formed to define a single essentially oval cross-section passage. A flow control valve 116 is disposed at the downstream end of each runner 114 (only one is shown) and arranged to be responsive to the operation of a servo device 118. The servo device 118 in this embodiment is arranged to close the flow control valves 116 when the engine is operating under low load/low speed conditions and also when the engine is operating under low speed/high load conditions (with the engine throttle valve 120 near or at full open) and to open the valves when the engine enters high speed/high load modes or conditions.

A fuel injector 122 is disposed in each of the branch runners 114 and arranged to inject fuel in a manner which forms a spray cone the center axis of which intersects with the wall member 124 which partitions the intake port into its first and second branches 126, 128, and which passes on the inboard sides of the stems of the inlet valves 102, 104.

With this arrangement the fuel tends to be essentially equally divided between the two branches 126, 128.

The flow control valve 116 is formed with two holes or apertures 130, 132 in the upper half of the valve blade 134. These holes 130, 132 are sized and located in a manner, when the valve 116 is closed, to cause the inducted charge to flow essentially as shown by the bold arrows.

As will be appreciated the main portion of these flows or injected fuel are such as to pass in close proximity to the sides of the partition wall 124 but without directly impinging on the same and undergoing a loss of kinetic energy. The relatively high speed air flows entrain the injected fuel and carry the same toward the inlet valves 102, 104.

This mode of induction does not promote the formation of swirl within the combustion chamber C/C and instead generates a turbulent mixing flow pattern as the mixture passes between the heads and seats of the inlet valves and promotes good mixing and carburetion of the fuel. The air-fuel mixture which is produced in the branches 126, 128 upstream of the inlet valves 102, 104 tends to pass between the valve heads and the valve seats predominantly on the inboard side of the valve stems and enter the combustion chamber C/C in close proximity to the electrodes of the centrally located spark plug 140 to form an ignitable cloud thereabout.

With this mixing mechanism it is possible to operate the engine stably on a lean air-fuel mixture.

When the engine is operating under low speed/high load conditions with the engine throttle valve 120 near or at wide open, as the amount of air being inducted is relatively small, it is within the scope of the present invention to close the flow control valve 116 and thus improve carburetion under such modes of operation.

When the engine is operating under high load/high speed conditions, for example, the flow control valve 116 is rotated to the position indicated in broken line in FIG. 3. This permits the relatively large volume of air inducted at this time to flow with minimum restriction toward the combustion chamber C/C and enables the system to operate at its full induction efficiency. During this mode of operation as the fuel is introduced into the combustion chamber via both branches 126, 128 the carburetion and distribution of the same within the combustion chamber C/C is improved increasing combustion efficiency and anti-knock characteristics.

Figure 5:
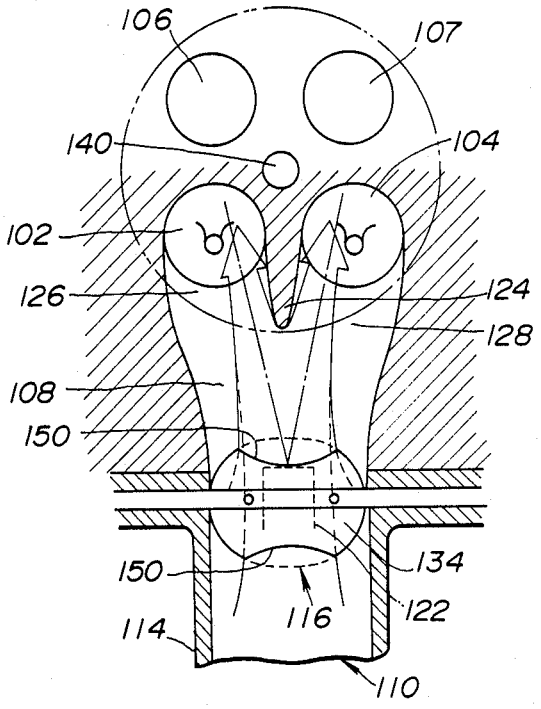
FIGS. 5 and 6 are sectional plan views showing second and third embodiments of the present invention.

FIG. 5 shows a second embodiment of the present invention. In this arrangement the flow control valve 116 is formed with curved recesses 150 at both the top and bottom of the valve blade. With this arrangement the torque which is applied to the valve blade 134 by the pressure which acts on its upstream face thereof when moved to assume its closed position, is minimized. This arrangement produces essentially the same effect as that of the first embodiment.

Figure 6:
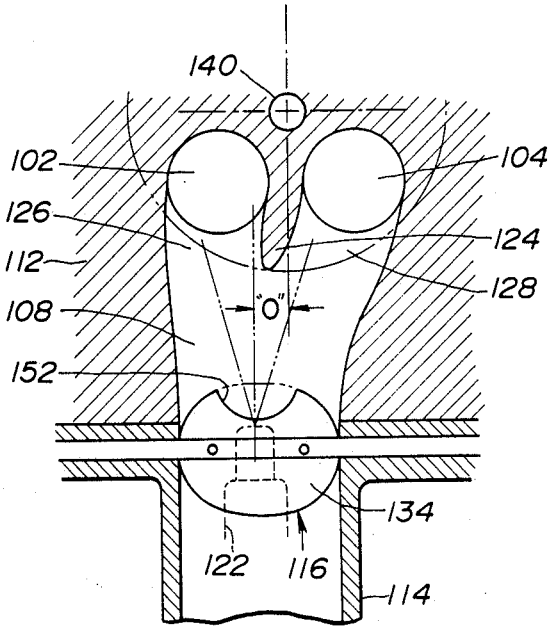

FIG. 6 shows a third embodiment of the present invention. This arrangement features the provision of a single curved recess 152 in the flow control valve blade and a slight offset "o" of the intake port with respect to the axis of the cylinder and the location of the spark plug. With this arrangement the amount of fuel which is injected into the branches 126, 128 is varied in a manner that an increased amount tends enter the combustion chamber via inlet valve 102.

Although the flows of air which pass through the curved recesses of the second and third embodiments tends to impinge on the leading edge of the partition wall 124, little loss of kinetic energy is experienced and fuel which has impinged thereon tends to be swept off and carried by the flow of air toward the inlet valves.

Figure 1:
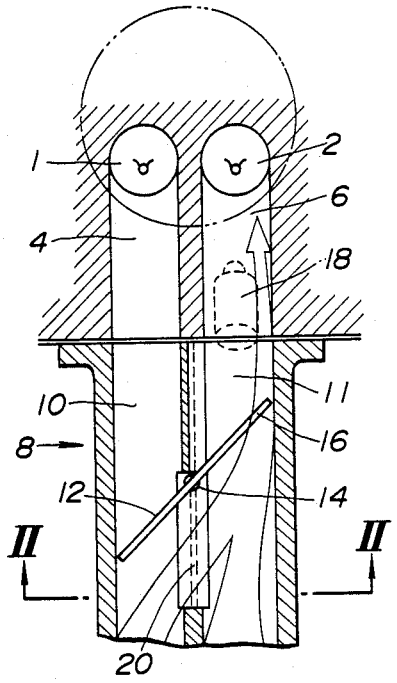
FIG. 1 (PRIOR ART)
FIGS. 1 and 2 show the prior art arrangement discussed in the opening paragraphs of the instant disclosure.
Figure 2:
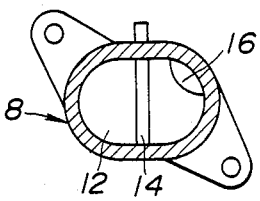
FIG. 2 (PRIOR ART)
Figure 7:
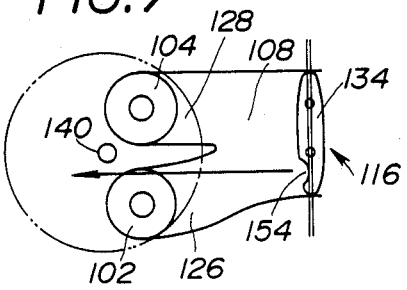
FIGS. 7 to 9 are plan and elevational views of a fourth embodiment of the present invention.
Figure 8:
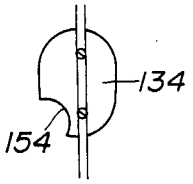
Figure 9:
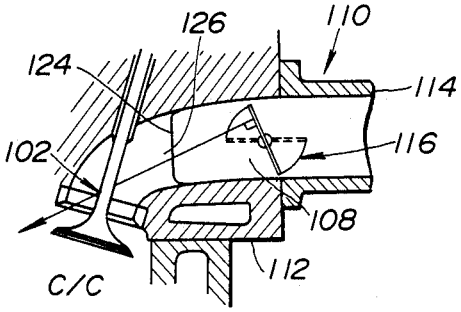

FIGS. 7 and 9 show a fourth embodiment of the present invention. With this embodiment the flow control blade 134 is formed with an aperture 154 which is offset with respect to the center of the combustion chamber and the axis of the associated cylinder and arranged, when the valve 116 is closed, to direct a flow of air into the combustion chamber as shown by the solid line arrow.

As will be appreciated from FIGS. 7 and 9 the flow is such as to predominantly pass between the valve head and the valve seat of the inlet valve 102 and enter the combustion close to the spark plug 140. This ensures the formation of a readily ignitable mixture proximate the electrodes thereof.

If desired the fuel injector 122 can be arranged slightly offset with respect to the cylinder axis in a manner similar to the embodiment shown in FIG. 6 so as to increase the proportion of fuel which is injected into the branch 126 as compared with that which passes into the branch 128. With this arrangement some of the air which passes through aperture 154 flows through branch 128 and entrains the fuel injected thereinto.

What is claimed is:

1. In an internal combustion engine a combustion chamber;

an induction manifold;

intake port means in communication with said induction manifold formed by a main section and first and second branch sections located downstream of said main section and separated one from the other by a partition wall extending toward said main section;

first and second inlet valves for controlling fluid communication between said combustion chamber and said first and second branch sections, respectively;

a fuel injector for injecting fuel into the main section of said intake port along a flow path toward said partition wall so that said fuel enters both said first and second branch sections; and a flow control valve disposed upstream of said first and second branch sections for control of flow of the entire volume of air from said induction manifold, said flow control valve including at least on aperture in a surface so that when the flow control valve assumes a closed position the flow of air which is inducted into the combustion chamber via the induction manifold follows a path of flow which is close to said partition wall to entrain the injected fuel and enter the combustion chamber in a manner which mixes the air and fuel.

2. An internal combustion engine as claimed in claim 1, further comprising:

a spark plug, said spark plug being arranged to project into the combustion chamber at a location essentially in the center thereof, and wherein:

said first and second inlet valves each comprise:

a valve head, a valve seat on which said valve head is seatable, and a valve stem which extends from said valve head and projects through the respective branch section.

3. An internal combustion engine as claimed in claim 2, wherein said flow control valve comprises:

a blade;

first and second apertures formed in said blade, said first and second apertures being arranged to direct first and second flows of air toward and into said first and second branch sections, respectively, whereby the first and second flows of air pass in close proximity to and on either side of said partition wall in a manner to entrain the fuel which is injected theretoward and carry the fuel predominantly past the inboard sides of the stems of said first and second inlet valves and into the combustion chamber in a manner to undergo mixing which forms an ignitably cloud of air-fuel mixture in close proximity to the electrodes of said spark plug.

4. An internal combustion engine as claimed in claim 2, wherein said flow control valve comprises:

a blade;

a first aperture formed in an edge of said blade and arranged to direct a flow of air toward said partition wall in a manner that the flow passes along either side of said partition wall and enters said combustion chamber predominantly on the inboard sides of the valve stems of said first and second inlet valves.

5. An internal combustion engine as claimed in claim 4, further comprising a second aperture, said second aperture being formed in an edge of said blade at a location essentially opposite the location said first aperture is formed, said second aperture directing a second flow of air toward said partition wall in a manner that the second flow passes along either side of said partition wall and enters said combustion chamber predominantly on the inboard sides of the valve stems of said first and second inlet valves.

6. An internal combustin engine as claimed in claim 2, wherein said flow control valve comprises:

a blade;

an aperture formed on an edge of said blade and arranged to direct a flow of air toward said partition wall in a manner that the flow passes predominantly along one side of said partition wall through said first branch section to enter said combustion chamber predominantly on the inboard side of the valve stem of said first inlet valve.

7. An internal combustion engine as claimed in claim 4, wherein the main section of said induction manifold is offset with respect to the center of said combustion chamber and said fuel injector is located in a position to inject more fuel into the first branch section than into the second branch section.

8. An internal combustion engine as claimed in claim 1, further comprising:

first and second exhaust valves; and exhaust port means, said exhaust port means including a main section and branch sections which lead from said first and second exhaust valves to said main section.

* * * * *